US006946412B2

(12) United States Patent
Campbell et al.

(10) Patent No.: US 6,946,412 B2
(45) **Date of Patent: *Sep. 20, 2005**

(54) FLAME-RESISTANT, HIGH VISIBILITY, ANTI-STATIC FABRIC AND APPAREL FORMED THEREFROM

(75) Inventors: Willis D. Campbell, Summerfield, NC (US); Richard M. Gibson, Weaverville, NC (US); Albert E. Johnson, Burlington, NC (US); Kenneth P. Wallace, Burlington, NC (US)

(73) Assignee: Glen Raven, Inc., Glen Raven, NC (US)

( * ) Notice: Subject to any disclaimer, the term of this patent is extended or adjusted under 35 U.S.C. 154(b) by 12 days.

This patent is subject to a terminal disclaimer.

(21) Appl. No.: 10/607,092

(22) Filed: Jun. 26, 2003

(65) Prior Publication Data

US 2004/0077241 A1 Apr. 22, 2004

Related U.S. Application Data

(63) Continuation-in-part of application No. 09/851,888, filed on May 9, 2001, now Pat. No. 6,706,650.

(51) Int. Cl.[7] ..... D03D 15/12; B32B 27/04; B27N 9/00

(52) U.S. Cl. ..... 442/302; 422/130; 422/164; 422/167; 422/181; 422/301; 428/365; 428/920; 428/921

(58) Field of Search ..... 442/130, 164, 442/167, 181, 301, 302; 428/365, 920, 921

(56) References Cited

U.S. PATENT DOCUMENTS

| | | | | | |
|---|---|---|---|---|---|
| 3,670,068 | A | * | 6/1972 | Jones et al. | 264/182 |
| 3,729,920 | A | * | 5/1973 | Sayers et al. | 57/227 |
| 3,806,959 | A | | 4/1974 | Gross | 5/334 R |
| 3,925,016 | A | * | 12/1975 | Haase | 8/580 |
| 4,001,477 | A | | 1/1977 | Economy et al. | 428/224 |
| 4,035,542 | A | | 7/1977 | Rosenthal et al. | 428/224 |
| 4,084,027 | A | | 4/1978 | Berni et al. | 427/390 D |
| 4,151,322 | A | | 4/1979 | Rosenthal et al. | 428/254 |
| 4,167,603 | A | | 9/1979 | Sistrunk | 428/260 |
| 4,266,940 | A | * | 5/1981 | Blackburn et al. | 8/538 |
| 4,336,028 | A | * | 6/1982 | Tomibe et al. | 8/624 |
| 4,348,306 | A | | 9/1982 | Mischutin | 252/608 |
| 4,433,493 | A | | 2/1984 | Poisson | 34/116 |
| 4,732,804 | A | | 3/1988 | Kujas | 428/229 |
| 4,970,105 | A | | 11/1990 | Smith, Jr. | 428/198 |
| 5,033,262 | A | * | 7/1991 | Montgomery et al. | 57/5 |
| 5,114,786 | A | | 5/1992 | Louis | 428/270 |
| 5,180,793 | A | | 1/1993 | Vigneault et al. | 525/446 |
| 5,323,815 | A | | 6/1994 | Barbeau et al. | 139/420 A |
| 5,348,796 | A | | 9/1994 | Ichibori et al. | 428/224 |
| 5,397,509 | A | | 3/1995 | Kostrzecha | 252/607 |
| 5,448,779 | A | | 9/1995 | Aldridge | 2/326 |
| 5,478,154 | A | | 12/1995 | Pappas et al. | 383/117 |
| 5,486,412 | A | | 1/1996 | Weinrotter et al. | 428/288 |
| 5,496,623 | A | | 3/1996 | Fox | 428/224 |
| 5,503,915 | A | | 4/1996 | Ichibori et al. | 428/224 |
| 5,503,916 | A | | 4/1996 | Ichibori et al. | 428/224 |
| 5,506,042 | A | | 4/1996 | Ichibori et al. | 428/224 |
| 5,688,429 | A | | 11/1997 | Zakikhani et al. | 252/8.61 |
| 5,728,448 | A | | 3/1998 | Okeya et al. | 428/193 |
| 5,855,623 | A | * | 1/1999 | English et al. | 8/115.56 |
| 5,948,148 | A | | 9/1999 | Cuevas B. | 106/18.13 |
| 6,626,964 | B1 | * | 9/2003 | Lunsford et al. | 8/531 |
| 6,800,367 | B2 | * | 10/2004 | Hanyon et al. | 428/364 |

FOREIGN PATENT DOCUMENTS

| | | | | |
|---|---|---|---|---|
| GB | 2152542 | * | 8/1985 | D04B/1/14 |

OTHER PUBLICATIONS

Pages of brochure for Westex Inc., believed to be prior art, date unknown.
Website printout for Head Lites Corporation, believed to be prior art, date unknown.

* cited by examiner

*Primary Examiner*—Terrel Morris
*Assistant Examiner*—Norca L. Torres
(74) *Attorney, Agent, or Firm*—Womble Carlyle Sandridge & Rice, PLLC; C. Robert Rhodes

(57) ABSTRACT

A fabric for use in safety apparel comprising a first set of yarns comprising modacrylic fibers, and a second set of yarns comprising anti-static fibers. The fabric meets the Federal Test Method Standard 191A, Method 5931 for electrostatic decay, and the Electrostatic Discharge Association Advisory ADV11.2-1995 voltage potential.

40 Claims, No Drawings

FLAME-RESISTANT, HIGH VISIBILITY, ANTI-STATIC FABRIC AND APPAREL FORMED THEREFROM

RELATED APPLICATIONS

This application is a continuation-in-part of the application Ser. No. 09/851,888, filed May 9,2001, now U.S. Pat. No. 6,706,650, issues Mar. 16, 2004.

FIELD OF THE INVENTION

The present invention relates generally to fabric and safety apparel formed therefrom, and more particularly to fabric and apparel that, in addition to meeting nationally-recognized standards for flame-resistance, high-visibility, and is anti-static.

BACKGROUND OF THE INVENTION

Authorities worldwide have recognized the need to protect occupational workers from the inherent hazards of apparel that is deficient in contrast and visibility when worn by workers exposed to the hazards of low visibility. These hazards are further intensified by the often complex backgrounds found in many occupations such as traffic control, construction, equipment operation, and roadway maintenance. Of major concern is ensuring that these workers are recognized by motor vehicle drivers in sufficient time for the drivers to slow-down or take other preventive action to avoid hazard or injury to the workers. Thus, worker safety is jeopardized when clothing not designed to provide visual identification is worn by persons working in such dangerous environments. While there are no federal regulations governing the design, performance, or use of high-visibility apparel, local jurisdictions and private entities have undertaken to equip their employees with highly luminescent vests. One national standards organization, known as the American National Standards Institute (ANSI), in conjunction with the Safety Equipment Association (ISEA), has developed a standard and guidelines for high-visibility luminescent safety apparel based on classes of apparel.

Similarly, and in related fashion, certain of the above-mentioned occupations also require safety apparel that is flame resistant. For example, electric utility workers who may be exposed to flammable situations require apparel that is flame resistant. In the United States, there is a nationally-recognized standard providing a performance specification for flame resistant textile materials for safety apparel, referred to as the American Society for Testing and Materials (ASTM), standard F 1506. This standard provides performance properties for textile materials used in apparel that represent minimum requirements for worker protection. One component of this standard is the vertical flame test which measures whether an apparel will melt or drip when subjected to a flame, or continue to bum after the flame is removed.

In recent years, utilities have become more diverse. Notably, electric utilities, for example, have diversified into the delivery of natural gas services. Thus, the same utility employees who provide electricity delivery services also service the natural gas network and facilities. This means that these employees not only require high visibility, and flame-resistant, but also require apparel that has anti-static properties suitable for wear in ignitable atmospheres.

Until recently, various items of safety apparel were produced to meet one or the other of these nationally-recognized standards, and products are now known that are capable of meeting all of the standards for flame-resistance and high-visibility; however, there are not known any fabrics that, in addition to meeting these requirements, are also anti-static.

SUMMARY OF THE INVENTION

The present invention is directed to a fabric, and apparel formed therefrom, that meets the minimum guidelines laid out in ANSI/ISEA-107-1999, "American National Standard for High-Visibility Safety Apparel", the vertical flame test of ASTM F 1506 (2000), "Standard Performance Specification for Flame Resistant Textile Materials for Wearing Apparel for Use by Electrical Workers Exposed to Momentary Electric Arc and Related Thermal Hazards", Federal Test Method Standard 191A, Method 5931 (1990), "Determination of Electrostatic Decay of Fabrics", and the Electrostatic Discharge Association advisory ESD ADV11.2-1995, "Triboelectric Charge Accumulation Testing".

ANSI/ISEA-107-1999 specifies requirements for apparel capable of signaling the wearer's presence visually and intended to provide conspicuity of the wearer in hazardous situations under any light conditions by day, and under illumination by vehicle headlights in darkness. As used herein, and as defined in ANSI/ISEA-107, "conspicuity" refers to the characteristics of an object which determine the likelihood that it will come to the attention of an observer, especially in a complex environment which has competing foreground and background objects. Conspicuity is enhanced by high contrast between the clothing and the background against which it is seen. The ANSI standard specifies performance requirements for color, luminance, and reflective area. Three different colors for background and combined performance are defined in the standard. The color selected should provide the maximum contrast with the anticipated background for use of the apparel. Several combinations are described in the standard depending upon the intended use. For example, the ANSI standard describes three classes of conspicuity. For utility workers, the apparel would meet either Class 2 or Class 3 (Appendix B of ANSI 107-1999). ASTM F 1506 provides a performance specification that may be used to evaluate the properties of fabrics or materials in response to heat and flame under controlled laboratory conditions. For exposure to an open flame, a fabric or apparel must not melt, drip, or continue to burn after the flame is removed. The properties of material for basic protection level wearing apparel should conform to the minimum requirements for woven or knitted fabrics with respect to breaking load, tear resistance, seam slippage, colorfastness, flammability before and after laundering, and arc testing. ASTM F 1506 specifies these performance characteristics based on fabric weight ranges, expressed in ounces per square yard. ASTM F 1506 establishes that an afterflame may not persist for more than 5 seconds when subjected to the arc testing of ASTMF 1959.

With respect to determining the anti-static properties of a fabric, there are several generally recognized test methods known in the art. While there is no one specific test for measuring electrostatic charge accumulation, two known methods provide some assurance that a fabric is electrostatically safe. Federal Test Method Standard 191A, Method 5931, Determination of Electrostatic Decay of Fabrics, which is incorporated herein in its entirety, provides a method for determining the time required for a charge on a fabric surface to decay to an electrostatically safe level. This test method is appropriate for use on material which may or may not contain conductive fibers of which has been treated with an anti-static finish. The primary purpose of the test is to determine whether a fabric is safe for wear during electrostatic sensitive operations. Specifically, the test method measures the amount of time, in seconds, for the static imparted to a fabric to decay from 5,000 Volts to 500 Volts.

The Electrostatic Discharge Association Advisory For Protection of Electrostatic Discharge Susceptible Items-Triboelectric Charge Accumulation Testing, ESD ADV 11.2-1995 provides a summary of tribocharging theory and test methods. The test methods contained in the Advisory have been designed to predict which materials will charge to what level and polarity when contacted with a given material. The vest was worn by a technician over a cotton shirt in a humidity controlled room. The field potential of the vest while being worn, as it was removed, and after it was removed was measured by a mill type electrostatic field meter. The potential of the hand of the technician was measured by a charge plate monitor while the vest was being worn and while it was being held after it was removed. In accordance with National Fire Protection Association Standard NFPA 77-2000, Recommended Practice on StaticElectricity, potentials of greater than 1,500 volts are considered hazardous in ignitable areas.

The rigorous performance specifications of each of the above test methods are met by the fabric and safety apparel formed from the unique yarns of the present invention. It has been found that a yarn formed substantially from modacrylic fibers, where some of the warp ends and fill picks further comprise anti-static fibers, will meet the anti-static requirements of Federal Test Method Standard 191 A, Method 5931, and ESD ADV 11.2-1995. It has also been found that a yarn formed substantially from modacrylic and stainless steel fibers will yield a fabric and apparel that meet the above standards. As used herein, the term "fiber" includes staples and filaments.

Modacrylics have characteristics that solve two problems addressed by the present invention. First, modacrylic yarns are inherently flame resistant, with the level of flame resistance varying based upon the weight percentage of acrylonitriles in the composition. Secondly, modacrylic yarns are very receptive to cationic dyes, which are known for their brilliance.

Aramid fibers are manufactured fibers in which the fiber-forming material is a long chain synthetic polyamide having at least 85% of its amide linkages (—NH—CO—) attached directly to two aromatic rings. Poly-para-phenylene terephthalamide is one such aramid which is produced from long molecular chains that are highly oriented with strong interactive bonding. When blended with the modacrylic fibers, the high tensile strength and high energy absorption properties of these materials contribute to even higher values for thermal performance and resistance to breakopen (formation of holes) when subjected to high energy. As used herein, and as well known in the art, the term "aramid" includes "meta-aramids" such as Nomex® and Conex™ , and "para-aramids" such as Kevlar® and Technora®.

In one exemplary embodiment, fabric constructed according to the present invention is formed from two types of yarns. One yarn type, also referred herein as "body yarn", since it forms substantially the main body of the fabric, is formed substantially from modacrylic fibers, or a blend of modacrylic fibers an aramid fibers that are spun in accordance with conventionally known techniques. It has been found that fabrics formed from such blended yarns, wherein the modacrylic fibers used to form the yarns provide a flame-resistance rating that meets at least the vertical flame burn test minimum criteria for safety apparel. The blended aramid fibers provide additional strength and energy absorption. The second yarn type, also referred herein as the "anti-static yarn", is a blend of modacrylic fibers and conductive anti-static fibers. It has been found that metallic fibers such as stainless steel fibers blended with modacrylic fibers provide suitable electrostatic discharge and low voltage potentials. In one preferred embodiment, the second yarn comprises about 20 percent stainless steel fibers and about 80 percent modacrylic fibers. As constructed, the first and second yarn types comprise at least about 85 percent of the fabric. The fabric may be either woven or knit. The inherently flame resistant material is dyed in conventional fashion in a jet dye machine with cationic, or basic, dyestuff compositions to obtain International Yellow or International Orange hues that will meet the luminescence and chromacity requirements of ANS/ISEA-107-999.

While the exemplary embodiment described herein is formed from yarns comprising an intimate blend of modacrylic and high performance, high energy absorptive fibers, and a blend of modacrylic fibers and stainless steel fibers, the yarn and fabric constructions are not limited thereto.

These and other aspects of the present invention will become apparent to those skilled in the art after a reading of the following description of the preferred embodiment.

DESCRIPTION OF THE PREFERRED EMBODIMENT

Having described the industry standards that provide the acceptance criteria for basic protection levels for occupational workers, the fabric, and apparel formed therefrom, of the present invention is formed from a two types of yarn that each comprise a blend of materials that will meet each of the standards.

In a preferred embodiment, the fabric construction comprises two types of yarns. One yarn type (the body yarn) is formed substantially from modacrylic fibers; however it may comprise a blend comprising at least about 70 percent to 97 percent modacrylic fibers, combined with at least about 3 percent to 30 percent high performance, high energy absorptive fibers of material having a tenacity of at least about 4 grams/denier, flame resistance, affinity for high-visibility dyestuffs, and good energy absorption. The second yarn type (the anti-static yarn) is a blend of modacrylic fibers and anti-static fibers. In one preferred embodiment, the anti-static fibers comprise stainless steel fibers; however, other metallic and non-metallic anti-static conductive fibers may also be used.

Modacrylics are polymers that have between 35 percent and 85 percent acrylonitrile units, modified by other chemical modifiers such as vinyl chloride. All modacrylics have a flame-resistant character to some extent, however, it has been found that fabrics formed from modacrylic yarns having at least about 50 percent by weight of acrylonitrile units will provide excellent flame resistance. That is, they will not melt and drip, or continue to burn when a source of ignition is removed. Although other modacrylic fibers could be used to form the yarn and fabric of the present invention, the yarn and fabric of the present invention is formed from short staple fibers of Kanecaron® SYS. Kanecaron® SYS is a 1.7 denier, 2 inch modacrylic staple fiber manufactured by Kaneka Corporation, Osaka, Japan. Kanecaron® SYS fiber has a tenacity of about 3 grams/denier, a Young's Modulus of about 270 kg/mm$^2$, a dull luster, and has been found to meet the structural requirements of both ANSI/ISEA-107-

1999 and ASTM F 1506. Modacrylic fibers having tenacities of at least about 2 grams/denier are also suitable to form the yarn and fabric of the present invention.

In some embodiments of the body yarn, modacrylic staple fibers are blended with long moledular chain fibers produced from poly-paraphenylene terephthalamide, a para-aramid commonly available from DuPont under the trademark Kevlar®, or available from Teijin Limited of Osaka, Japan under the trademark Technora®. These aramid fibers provide suitable fire resistance, strength, and energy absorption. These staple fibers have tenacities greater than about 20 grams/denier.

In other embodiments of the body yarn, it has been found that yarns formed of modacrylic fibers blended with meta-aramid fibers commonly available from DuPont under the trademark Nomex®, or from Teijin Limited under the label Conex™ also provide quite suitable fire-resistance, strength, and energy absorption. These fibers have tenacities greater than about 4 grams/denier.

Yarns of the first type, the body yarns, and fabric formed therefrom, according to the present invention requires at least about 70 percent modacrylic fibers and at least about 3 percent aramid fibers when blended with one of the aforementioned energy absorptive materials in order to meet the ANSI, ASTM, and NFPA standards described above. Preferably, fabric with blends containing about 90 percent or more of the modacrylic fibers and at least about 3 percent of the high energy absorptive fibers provides the most acceptable results. The following Table I is exemplary of some yarn constructions for the first yarn type that have been formed according to the present invention.

TABLE I

| Construction | modacrylic Fibers | Aramid Fibers |
|---|---|---|
| A | 90% Kanecoran ® SYS, 1.7 denier, 2.0 inch fibers | 10% Technora ®, 1.7 denier, 2.0 inch fibers |
| B | 95% Kanecoran ® SYS, 1.7 denier, 2.0 inch fibers | 5% Kevlar ®, 1.7 denier, 2.0 inch fibers |
| C | 90% Kanecoran ® SYS, 1.7 denier, 2.0 inch fibers | 10% Nomex ®, 1.7 denier, 2.0 inch fibers |
| D | 90% Kanecoran ® SYS, 1.7 denier, 2.0 inch fibers | 5% Nomex ®, 1.7 denier, 2.0 inch fibers; 5% Kevlar ®, 1.7 denier, 2.0 inch fibers |

In the second, or anti-static yarn, modacrylic staple fibers are blended with anti-static fibers. While anti-static fibers are not limited to metallic fibers, in one embodiment the anti-static fibers are stainless steel. Such a yarn construction is available from Cavalier Textiles of Sherbrooke, Quebec, Canada as Item No. 43334-C9Y9. This yarn construction comprises 80% modacrylic (Kanecaron SYS) staple fibers and 20% stainless steel staples fibers. The modacrylic fibers have a denier of 1.7 and a length of about 2 inches, and the stainless steel fibers have a diameter of about 8 microns ( equivalent to about 3.617 denier) and a length of about 2 inches; however, the yarn construction is not limited to a particular yarn size or to particular staple fiber sizes.

As constructed, the first and second yarn types comprise at least about 85 percent of the fabric.

With respect to static decay, a safety garment (vest) woven from yarns comprising a first yarn type of 100% modacrylic fibers and a second yarn type of modacrylic and stainless steel fibers was tested in accordance with Federal Test Method Standard 191A, Method 5931 (1990), incorporated herein in its entirety. In accordance with this method, six specimens are tested, three in the fabric warp direction and three in the fabric fill direction. Each specimen is about 3 by 5 inches and the direction of testing (warp or fill) is along the length of the specimen. As a precondition, the specimens are maintained in an environment having a relative humidity of between 8 and 12 percent and then conditioned at between 18 and 22 percent relative humidity for a minimum of 24 hours. The specimens are tested at between 18 and 22 percent relative humidity and between 70 and 80 degrees Fahrenheit. A voltage source applies 5,000 volts to the specimen. A measure is then made of the time in seconds required for the 5,000 volts to decay to 500 volts. The specimen is acceptable if the decay time to 500 volts (10 percent of the starting voltage) is less than 0.5 seconds, and considered not acceptable otherwise. The results of the testing are shown in the following Table II.

TABLE II

| | Maximum | Minimum | Average | Std. Dev. |
|---|---|---|---|---|
| +5 kV | 0.01 | 0.01 | 0.01 | 0.0 |
| −5 kV | 0.01 | 0.01 | 0.01 | 0.0 |

The average time to decay to 500 volts for each of the warp and fill directions as 0.01 seconds, which is the lower limit of the test method. As shown in the Table, the overall average for the fabric was also 0.01 seconds.

Testing was also undertaken in accordance with ESD ADV11.2-1995, Triboelectric Charge Accumulation Testing. In accordance with this test method, a garment (vest) was tested at 12 percent relative humidity and 72 degrees Fahrenheit. The vest was worn by a technician over a cotton shirt in a humidity controlled room. The field potential of the vest while being worn, as it was removed, and after it was removed was measured by a mill type electrostatic field meter. The potential of the hand of the technician was measured by a charge plate monitor while the vest was being worn and while it was being held after it was removed. In accordance with National Fire Protection Association Standard NFPA 77-2000, Recommended Practice on StaticElectricity, potentials of greater than 1,500 volts are considered hazardous in ignitable areas. As shown in Table III, the highest potential measured was only 570 volts/meter. Although ESD ADV11.2 warns that test results are not necessarily repeatable, the inventors have concluded through independent testing that the measured potential voltage is sufficiently low that the vest is considered suitable for use in areas where ignitable atmospheres are present.

TABLE III

| Electrostatic Field | Maximum Voltage Measured |
|---|---|
| Vest as Worn | 570 Volts/meter |
| Vest Being Removed | 380 Volts/meter |
| Vest After Removal | 150 Volts/meter |
| Potential on Person Wearing Vest | 250 Volts |
| Potential on Person Holding Removed Vest | 280 Volts |

The process for making fabric according to the present invention, using the materials described above, is discussed in detail below.

The Process

As described above, the anti-static yarn, i.e., the second yarn type is available from Cavalier Textiles. In one preferred embodiment, that yarn construction is 30 singles, 2 ply; however, the yarn construction is not limited thereto. With respect to the first yarn type construction, as is conventional in short staple yarn manufacture, bales of short staple fibers, in the percentages described above, are initially subjected to an opening process whereby the compacted fibers are "pulled" or "plucked" in preparation for carding. Opening serves to promote cleaning, and intimate blending of fibers in a uniform mixture, during the yarn formation process. Those skilled in the art will appreciate that there are a number of conventional hoppers and fine openers that are acceptable for this process. The open and blended fibers are next carded using Marzoli CX300 Cards to form card slivers. The card slivers are transformed into drawing slivers through a drawing process utilizing a process known as breaker drawing on a Rieter SB951 Drawframe and finisher drawing on a Rieter RSB951 Drawframe. Drawn slivers are next subjected to a Roving process conventionally known in preparation for Ring Spinning. A Saco-Lowell Rovematic Roving Frame with Suessen Drafting is used to twist, lay and wind the sliver into roving. A Marzoli NSF2/L Spinning Frame is used to ring spun the yarn product. Winding, doubling, and twisting processes conventionally known in the art are used in completing the yarn product. A finished yarn found structurally suitable for the present invention is an 18 singles, 2-ply construction.

The illustrated fabric is woven; however, other constructions, such as knitted, and non-woven constructions may be used, provided they meet the design and structural requirements of the two standards. Additionally, it has been found that up to about 15 percent of the total fabric weight may comprise other synthetic materials, such as polyester, nylon, etc.

The exemplary fabric is woven (plain weave) on a Picanol air jet loom with 46 warp ends and 34 fill ends of yarn per inch and an off-loom width of 71 inches. In a preferred embodiment, after every 43 ends (picks) in the fill direction, one pick of anti-static fiber is woven in. In the warp direction, one end of anti-static yarn is woven in after every 55 ends of modacrylic yarn. This creates an anti-static grid of about 20 mm and is approximately square, after finishing of the fabric; however smaller and larger grid sizes will also provide suitable results. It has been found by the inventors that the anti-static yarns must be woven in both the warp and fill directions to obtain these grids to provide suitable static decay and acceptable potential voltages. Any looms capable of weaving modacrylic yarns may just as suitably be used. The woven fabric has a desired weight of approximately 4 to 20 ounces per square yard, and desirably about 7.5 ounces per square yard as necessary to satisfy the design requirements for the particular class of safety apparel.

In preparation for dyeing, the woven fabric is subjected to desizing and scouring to remove impurities and sizes such as polyacrylic acid. The process of desizing is well known in the art. A non-ionic agent is applied in a bath at between about 0.2 and 0.5 weight percent of the fabric and an oxidation desizing agent is applied in a bath at about 2 to 3 percent of fabric weight. The use of such agents is well known in the art. The processing, or run, time for desizing and scouring is approximately 15 to 20 minutes at 60° C. The fabric is then rinsed with water at a temperature of 60° C.

The pretreated fabric is then ready for dyeing and finishing. The dyeing is formed in a jet dye machine such as a Model Mark IV manufactured by Gaston County Machine Company of Stanley, N.C. The specific dyes used to color the fabric of the present invention are basic, or cationic, dyestuffs. The cationic dyes are known for their acceptability in dyeing polyesters, nylons, acrylics, and modacrylics. However, it has heretofor not been known that these dyes could be formulated to dye modacrylic material in order to meet the luminance and chromacity criteria for safety apparel according to ANSI/ISEA-107 and the fire resistant criteria of ASTM F 1506. Two dye formulations have been found to meet the high visibility criteria for ANSI/ISEA-107. A dye formulation for International Yellow comprises basic Flavine Yellow, available from Dundee Color of Shelby, N.C. as color number 10GFF. It has been found that this dyestuff applied at between about 2 to 2½ percent of fabric weight successfully achieves the ANSI criteria. A dye formulation for International Orange may be formed from Blue and Red cationic dyestuffs, available from Yorkshire America in Rock Hill, S.C., as color numbers Sevron Blue 5GMF and Sevron Brilliant Red 4G and applied at percentages sufficient to meet the ANSI/ISEA-107 shade requirements.

Either of the dyestuffs described above are added to the jet dye machine. The Ph of the bath is established at between about 3 and 4, with acid used to adjust the Ph as required. The bath temperature in the jet dyer is raised at about 1° C. per minute to a temperature of about 80° C., where the temperature is held for approximately 10 minutes. The temperature is then raised approximately 0.5° C. per minute to a temperature of 98° C. and held for approximately 60 minutes. The bath is then cooled at about 2° C. per minute to 60° C. At that point, the bath is emptied and rinsing with water at 60° C. occurs until the dye stuff residue in the jet dyer is removed. At this point, the dyeing cycle is complete. Wet fabric is removed from the dye machine where it is dried on a standard propane open width tenter frame running at approximately 40 yards per minute at approximately 280° F. to stabilize width and shrinkage performance. At the completion of this process, a fabric that meets the ANSI standard for high visibility safety apparel, the ASTM standard for flame resistance, the fabric construction also meets the Federal Test Method Standard 191 A, Method 5931 for electrostic decay, and the ESD ADV11.2-1995 standard for voltage potential.

The finished fabric may be used to construct an unlimited number of types of safety apparel. The most common types are shirts or vests, and trousers or coveralls. The final constructed garments are designed and formed to meet the design, structural, and fastening criteria of the ANSI and ASTM standards.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A fabric for use in safety apparel, comprising:

(a) a first yarn type comprising an intimate blend of:
at least about 70 percent modacrylic fibers
and high energy absorptive fibers;

(b) a second yarn type comprising an intimate blend of:
anti-static fibers
and modacrylic fibers; and (c) wherein, the fabric meets the Federal Test Method Standard 191A, Method 5931 for electrostatic decay, and the Electrostatic Discharge Association Advisory ADV11.2-1995 for voltage potential.

2. The fabric of claim 1 wherein said anti-static fibers are stainless steel fibers.

3. The fabric of claim 2 wherein the second yarn type comprises about 20 percent stainless steel fibers.

4. The fabric of claim 1 wherein the second yarn type further comprises high energy absorptive fibers.

5. The fabric of claim 1 wherein the fabric comprises at least about 1 percent anti-static yarns.

6. The fabric of claim 1 wherein the first and second yarn types comprise at least about 85 percent of the fabric.

7. The fabric of claim 1 further comprising a dye applied to said fabric, wherein when the dye is applied to said fabric, the dyed fabric meets the American National Standard Institute standard ANSI/ISEA-107 minimum conspicuity level class requirements for occupational activities for high-visibility safety apparel.

8. The fabric of claim 4 wherein said modacrylic fibers and said high energy absorptive fibers are intimately blended staple fibers.

9. The fabric of claim 4 wherein the fabric meets the American Society for Testing and Materials standard ASTM F-1506 for flame resistance.

10. The fabric of claim 1 wherein said fabric is woven.

11. The fabric of claim 4 wherein said first yarn type comprises between about 70 percent and 97 percent modacrylic fibers and between about 3 percent and 30 percent high energy absorptive fibers.

12. The fabric of claim 8 wherein said blend of fibers comprises between about 90 percent and 97 percent modacrylic fibers and at least about 3 percent high energy absorptive fibers.

13. The fabric of claim 1 wherein said modacrylic fibers contain at least 50 percent acrylonitrile.

14. The fabric of claim 1 wherein said modacrylic fibers have a tenacity of at least about 2 grams/denier.

15. The fabric of claim 4 wherein the high energy absorptive fibers are aramid.

16. The fabric of claim 15 wherein the aramid is formed from poly-paraphenylene terephthalamide.

17. The fabric of claim 4 wherein the high energy absorptive fibers are selected from the group of fibers consisting of meta-aramids and para-aramids.

18. The fabric of claim 4 wherein said high energy absorptive fibers have a tenacity of at least about 4 grams/denier.

19. The fabric of claim 10 wherein said woven fabric has a tensile strength of at least about 100 pounds in the warp direction and at least about 100 pounds in the weft direction.

20. The fabric of claim 10 wherein said woven fabric has a tear resistance of at least about 1360 grams.

21. The fabric of claim 10 wherein said woven fabric comprises anti-static fibers in both the warp and fill directions.

22. A safety garment having high visibility and flame resistant characteristics formed from:

(a) a fabric comprising a first yarn type and a second yarn type;

(b) the first yarn type comprising an intimate blend of:
at least bout 70 percent modacrylic fibers
and high energy absorptive fibers;

(c) the second yarn type comprising an intimate blend of:
anti-static fibers
and modacrylic fibers; and (d) wherein, the fabric meets the Federal Test Method Standard 191A, Method 5931 for electrostatic decay, and the Electrostatic Discharge Association Advisory ADV11.2-1995 for voltage potential.

23. The safety garment of claim 22 wherein said anti-static fibers are stainless steel fibers.

24. The safety garment of claim 23 wherein the second set of yarn ends comprises about 20 percent stainless steel fibers.

25. The safety garment of claim 22 wherein the second yarn type further comprises high energy absorptive fibers.

26. The safety garment of claim 22 further comprising a dye applied to said fabric, wherein when the dye is applied to said fabric, the dyed fabric meets the American National Standard Institute standard ANSI/ISEA-107 minimum conspicuity level class requirements for occupational activities for high-visibility safety apparel.

27. The safety garment of claim 25 wherein the fabric meets the American Society for Testing and Materials standard ASTM F-1506 for flame resistance.

28. The safety garment of claim 25 wherein said modacrylic fibers and said high energy absorptive fibers are intimately blended staple fibers.

29. The safety garment of claim 22 wherein said fabric is woven.

30. The safety garment of claim 22 wherein said fabric comprises at least about 70 percent modacrylic fibers and at least about 3 percent high energy absorptive fibers.

31. The safety garment of claim 22 wherein said fabric comprises between about 90 percent and 97 percent modacrylic fibers and at least about 3 percent high energy absorptive fibers.

32. The safety garment of claim 22 wherein said modacrylic fibers contain at least 50 percent acrylonitrile.

33. The safety garment of claim 22 wherein said modacrylic fibers have a tenacity of at least about 2 grams/denier.

34. The safety garment of claim 25 wherein the high energy absorptive fibers are aramid.

35. The safety garment of claim 34 wherein the aramid is formed from poly-paraphenylene terephthalamide.

36. The safety garment of claim 25 wherein the high energy absorptive fibers are selected from the group of fibers consisting of meta-aramids and para-aramids.

37. The safety garment of claim 25 wherein said high energy absorptive fibers have a tenacity of at least about 4 grams/denier.

38. The safety garment of claim 29 wherein said woven fabric has a tensile strength of at least about 100 pounds in the warp direction and at least about 100 pounds in the weft direction.

39. The safety garment of claim 29 wherein said woven fabric has a tear resistance of at least about 1360 grams.

40. The safety garment of claim 29 wherein said woven fabric comprises anti-static fibers in both the warp and fill directions.

* * * * *